US006306515B1

(12) United States Patent
Goedjen et al.

(10) Patent No.: US 6,306,515 B1
(45) **Date of Patent: *Oct. 23, 2001**

(54) THERMAL BARRIER AND OVERLAY COATING SYSTEMS COMPRISING COMPOSITE METAL/METAL OXIDE BOND COATING LAYERS

(75) Inventors: John G. Goedjen, Oviedo; Stephen M. Sabol, Orlando; Kelly M. Sloan, Longwood; Steven J. Vance, Orlando, all of FL (US)

(73) Assignee: Siemens Westinghouse Power Corporation, Orlando, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/133,763

(22) Filed: Aug. 12, 1998

(51) Int. Cl.[7] ..... B32B 9/00

(52) U.S. Cl. ..... 428/469; 428/472.2; 428/937; 416/241 B

(58) Field of Search ..... 428/469, 472.2, 428/610, 623, 632, 667, 678, 679, 680, 937; 416/241 R, 241 B

(56) References Cited

U.S. PATENT DOCUMENTS

| | | | | |
|---|---|---|---|---|
| 3,928,026 | * | 12/1975 | Iecht et al. | 75/134 |
| 4,248,940 | * | 2/1981 | Goward et al. | 428/633 |
| 4,446,199 | | 5/1984 | Gedwill et al. | 428/639 |
| 4,451,496 | | 5/1984 | Gedwill et al. | 427/34 |
| 4,471,017 | | 9/1984 | Poeschel et al. | 428/215 |
| 4,481,237 | * | 11/1984 | Bosshart et al. | 427/376.4 |
| 4,503,130 | | 3/1985 | Bosshart et al. | 428/632 |
| 4,966,820 | | 10/1990 | Kojima et al. | 428/622 |
| 5,209,645 | | 5/1993 | Kojima et al. | 416/241 |
| 5,305,726 | * | 4/1994 | Scharman et al. | 123/668 |
| 5,320,909 | * | 6/1994 | Scharman et al. | 428/472 |
| 5,514,482 | * | 5/1996 | Strangman | 428/623 |
| 5,624,721 | * | 4/1997 | Strangman | 427/585 |
| 5,683,825 | * | 11/1997 | Bruce et al. | 428/698 |
| 5,817,372 | | 10/1998 | Zheng . | |
| 5,912,087 | * | 6/1999 | Jackson et al. | 428/610 |

FOREIGN PATENT DOCUMENTS

| | | |
|---|---|---|
| 0845547 | 6/1998 | (EP) . |
| 0340791 | 11/1999 | (EP) . |

OTHER PUBLICATIONS

Brandle, W. et al., Characteristics of Alumina Scales Formed on HVOF–Sprayed McrAlY Coatings, Proceedings of the 1998 25$^{th}$ International Conference on Metallurgical Coatings and Thin Films, in Surf Coat Technol: Oct. 10, 1998, vol. 108–109, pp. 10–15 Elsevier Science, S.A. Lausanne, Switzerland.

O. Knotek et al., "Diffusion Barrier Coatings With Active Bonding, Designed For Gas Turbine Blades," *Surface and Coatings Technology*, 68/69 (1994), pp. 22–26.

A.A. Kodentsov et al., "High Temperature Nitridation of Ni–Cr Alloys," *Metallurgical and Materials Transactions A*, vol. 27A, No. 1, Jan. 1996, pp. 59–69.

* cited by examiner

*Primary Examiner*—Deborah Jones
*Assistant Examiner*—Bryant Young
(74) *Attorney, Agent, or Firm*—Eckert Seamans Cherin & Mellott, LLC

(57) ABSTRACT

The present invention generally describes multilayer coating systems comprising a composite metal/metal oxide bond coat layer. The coating systems may be used in gas turbines.

14 Claims, 3 Drawing Sheets

THERMAL BARRIER AND OVERLAY COATING SYSTEMS COMPRISING COMPOSITE METAL/METAL OXIDE BOND COATING LAYERS

GOVERNMENT INTEREST

This invention was made with government support under Contract No. DE-AC05-950R22242, awarded by the United States Department of Energy. The government has certain rights in this invention.

FIELD OF THE INVENTION

The present invention generally describes multilayer coating systems comprising a composite metal/metal oxide bond coating layer. The coating systems of the present invention may be used in gas turbines.

BACKGROUND OF THE INVENTION

In gas turbine applications, superalloys, MCrAlY bond coatings, and overlay coatings often contain elements such as aluminum or chromium for oxidation and corrosion resistance. One or more of these elements form a thermally grown oxide (TGO) layer on the surface which acts as a barrier to further oxidation and corrosion. Over time, alloying elements like Ti, W, Ta or Hf diffuse up from the substrate and into the thermally grown oxide layer. Such impurities degrade the thermally grown oxide layer and reduce its protective ability. There can also be a significant loss of aluminum via diffusion from the bond coat into the substrate, thereby reducing the aluminum reservoir required to maintain the protective layer.

There is a need in the art for thermal barrier coating systems and overlay coating systems that reduce interdiffusion of elements between the substrate and the bond coat in order to increase the life of the systems. The present invention is directed to these. as well as other, important ends.

SUMMARY OF THE INVENTION

The present invention generally describes multilayer thermal barrier coating systems comprising a thermal barrier coating, layer, a high density metallic bond coating layer, a composite metal/metal oxide bond coating layer and a substrate. The thermal barrier coating systems further comprise a thermally grown oxide layer that forms during manufacture and/or service.

The present invention also generally describes overlay coating systems comprising a high density metallic bond coating layer, a composite metal/metal oxide bond coating layer and a substrate.

The present invention also describes methods of making multilayer thermal barrier coating system comprising depositing a composite metal/metal oxide bond coating layer on a substrate; depositing a high density metallic bond coating layer on the composite metal and oxide bond coating layer; and depositing a thermal barrier coating layer on the high density metallic bond coating layer. The method further comprises heating the multilayer thermal barrier coating system to produce a thermally grown oxide layer between the thermal barrier coating layer and the high density metallic bond coating layer.

The present invention also describes methods of making multilayer overlay coating system comprising depositing a composite metal/metal oxide bond coating layer on a substrate, and depositing a high density metallic bond coating layer on the composite metal/metal oxide bond coating layer.

These and other aspects of the present invention will become clearer from the following detailed description.

DETAILED DESCRIPTION OF THE INVENTION

The present invention generally describes multilayer thermal barrier coating systems for high temperature, hot section, turbine applications including, but not limited to, blades, vanes, combustors, and transitions.

The conventional approach to applying thermal sprayed MCrAlY bond coat or overlay coating is to minimize the amount of oxides in the layer by adjusting processing parameters, controlling the surrounding atmosphere, such as by shrouding with argon, or by spraying in a low pressure or vacuum chamber. The combination of an air plasma sprayed MCrAlY bond coating, with intentionally incorporated oxide, acts as a chemical diffusion barrier between the substrate and the MCrAlY coating. The addition of a second low pressure plasma sprayed (LPPS) or high velocity oxygen fuel (HVOF) bond coating layer, above the air plasma sprayed (APS) diffusion barrier, provides a platform for formation of a slow-growing, adherent oxide layer.

Figure 1:
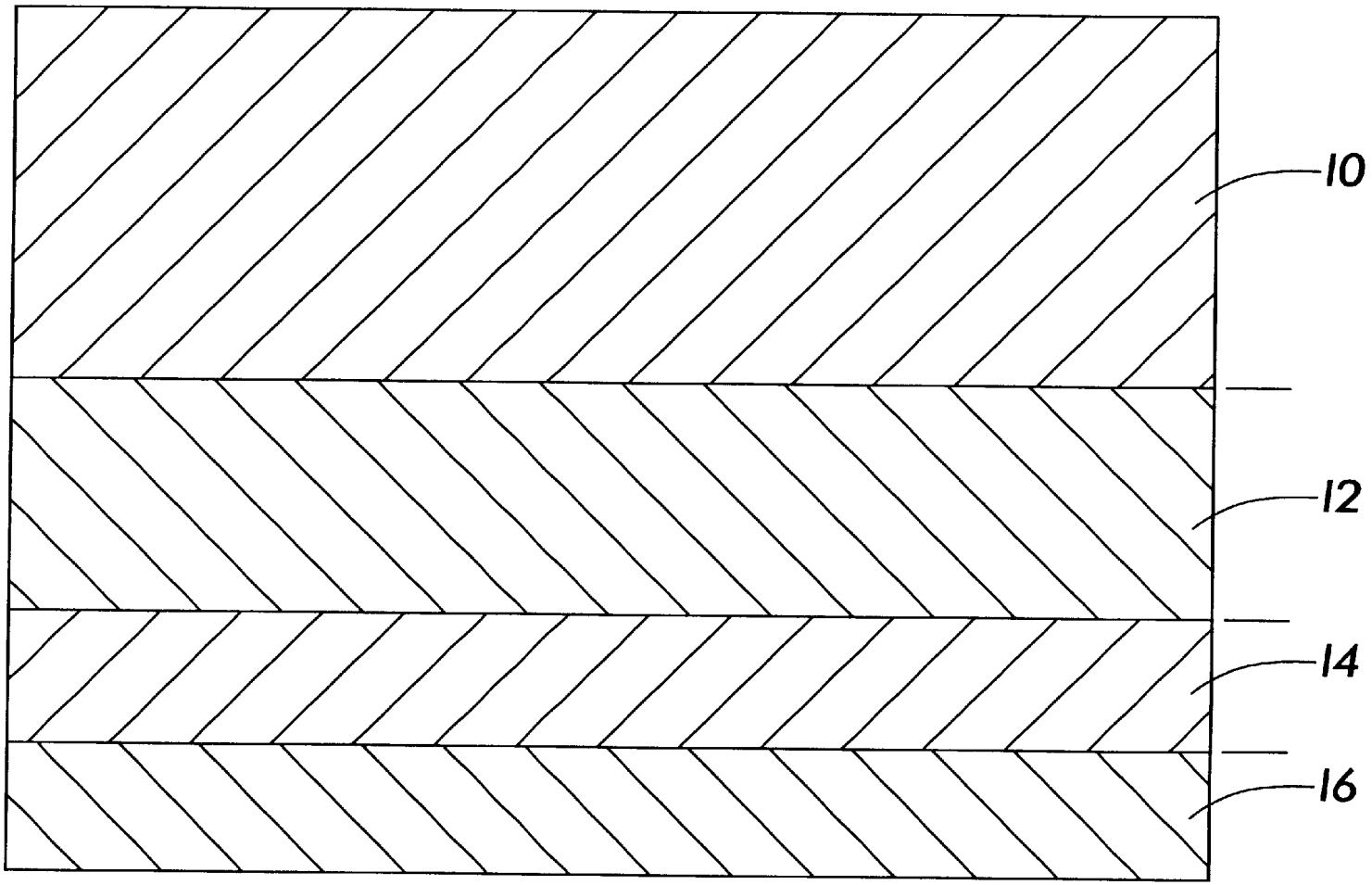
FIG. 1 is a cross-sectional view of multilayer thermal barrier coating systems of the present invention comprising a thermal barrier coating layer, a high density metallic bond coating layer (MCrAlY), a composite metal/metal oxide bond coating layer and a substrate.
Figure 2:
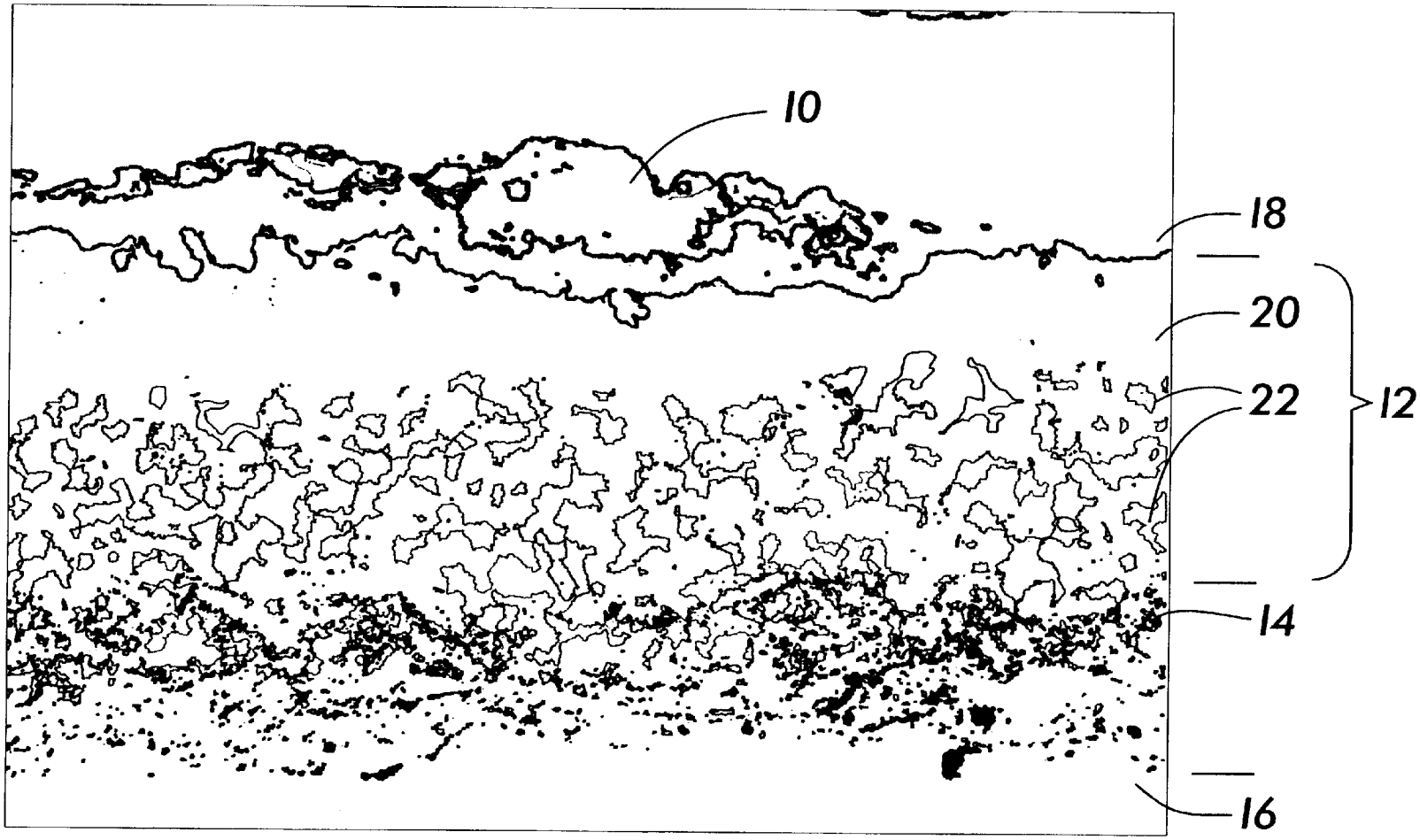
FIG. 2 is a cross-sectional view of multilayer thermal barrier coating systems of the present invention comprising a thermal barrier coating layer, a thermally grown oxide layer, a high density metallic bond coating layer (MCrAlY), a composite metal/metal oxide bond coating layer and a substrate after thermal bond coating failure as a result of thermal exposure.
Figure 3:
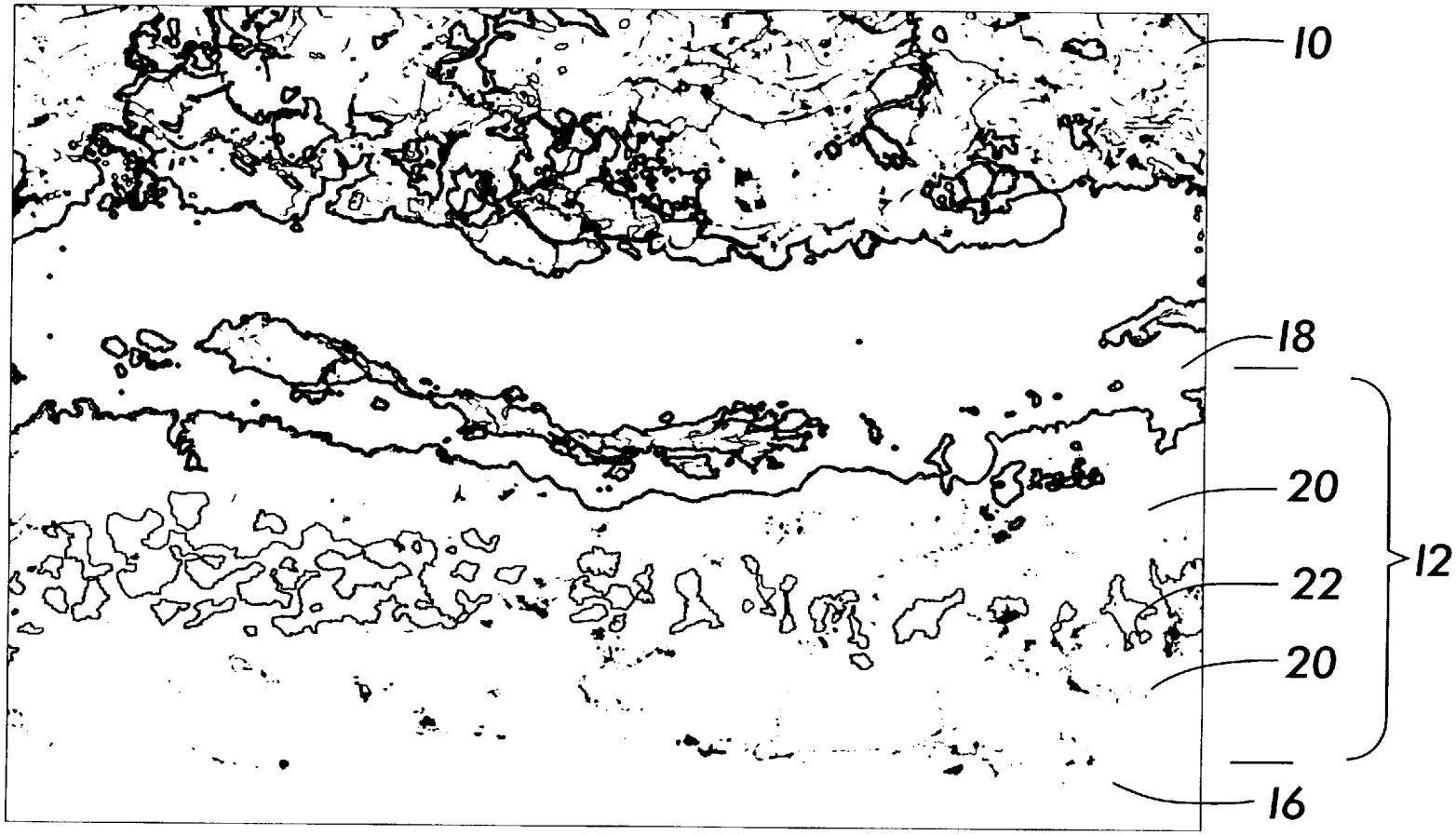
FIG. 3 is a cross-sectional view of multilayer thermal barrier coating system of the current state of the art comprising a thermal barrier coating layer, a thermally grown oxide layer, a high density metallic bond coating layer (MCrAlY), and a substrate WITHOUT the composite metal/metal oxide bond coating layer after thermal bond coating failure as a result of thermal exposure.

Referring to FIGS. 1, 2, and 3, the multilayer thermal barrier coating systems of the present invention comprise a thermal barrier coating layer 10, a thermally grown oxide layer 18, a high density metallic bond coating layer 12, a composite metal/metal oxide bond coating layer 14 and a substrate 16.

The thermal barrier coating layer 10 is generally an 8% yttrium stabilized zirconia layer that is applied by methods known to one skilled in the art, such as air plasma spraying or physical vapor deposition. The thermal barrier coating layer 10, however, may also be comprised of magnesia stabilized zirconia, ceria stabilized zirconia, scandia stabilized zirconia or other ceramic with low conductivity. The thermal barrier coating layer 10 is typically present at a thickness of about 5–20 mils.

The thermally grown oxide layer 18 (not shown in FIG. 1) is established during manufacturing and/or service exposure and is typically comprised of aluminum oxide. The thermally grown oxide layer 18 grows continuously during the service of the component due to exposure to high temperature oxidizing environments. This growth has been observed to be anywhere from 0 to 15 micrometers thick.

More typical, however, is 0 to 10 micrometers thick. In the case of EB-PVD TBC ceramic top coats, the formation of the thermally grown oxide layer 18 is initiated during the coating process itself and provides an oxide surface for the columnar thermal barrier coating layer 10 growth. The temperatures involved are those consistent with current industrial practice for thermal barrier coating deposition and temperatures and times associated with engine operation. Generally, temperatures in excess of 1400 degrees F. are necessary for substantial thermally grown oxide layer 18 formation.

The high density metallic bond coating layer 12 is generally an MCrAlY alloy deposited by methods known to one skilled in the art, such as high velocity oxygen fuel or low pressure plasma spray techniques. A typical form of MCrAlY is where M is nickel and/or cobalt and Y is yttrium. In addition, there are numerous modifications where additional alloying elements have been added to the mix including rhenium, platinum, tungsten, and other transition metals. NiCoCrAlY's and CoNiCrAlY's are by far the most common. For most industrial gas turbine applications, the high density metalic bond coating layer, or MCrAlY layer 12 is typically about 4–10 mils thick unless a particular process restriction requires thicker coatings whereby the metallic bond coating layer 12 accordingly will be thicker. For aero applications, the MCrAlY is typically thinner and may be found at about 2–5 mils thick.

In a preferred embodiment of this invention, the dense MCrAlY layer 12 comprises 50–90% of the total bond coat thickness (both layers) and the composite metal/metal oxide layer 14 comprises 10–50% of the coating thickness. More preferably, the MCrAlY layer 12 comprises 70% of the total bond coat thickness (both layers) and the composite metal/metal oxide layer 14 comprises the other 30% of the coating thickness.

The composite metal/metal oxide layer 14 acts as a diffusion barrier. Preferably, the layer is deposited using methods known to one skilled in the art, such as air plasma spray techniques which can be made to produce a lamellar structure of metal/metal oxide layers 14 which act as a diffusion barrier. This composite metal/metal oxide layer 14 can be formed from any MCrAlY that can be made or is commercially available.

The structure of the composite metal/metal oxide layer 14 of the current invention is formed by the insitu oxidation of MCrAlY particles which occurs during air plasma spray by the reaction of the surface of the molten MCrAlY droplet with oxygen in the air. There are, however, other means of establishing the composite metal/metal oxide 14 are feasible. For example, the objectives set forth in this invention can be accomplished by thermal spray co-deposition of ceramic (alumina) and MCrAlY where both powders are fed into the plasma gun either simultaneously or sequentially to build up an alternating layer, or by alternating deposition of thin layers followed by oxidation heat treatments between gun passes such that the diffusion barrier layer is made up of alternating metal-ceramic layers where the layers are continuous or disrupted.

The term "substrate" 16 refers to the metal component onto which thermal barrier coating systems are applied. This is typically a nickel or cobalt based superalloy such as IN738 made by Inco Alloys International, Inc. More specifically, in a combustion turbine system, the substrate 16 is any hot gas path component including combustors, transitions, vanes, blades, and seal segments.

FIGS. 2 and 3 illustrate the advantage of using the composite metal/metal oxide layer 14 of the present invention between the MCrAlY bond coat layer 12 and the superalloy substrate 16. The coating in FIG. 2 contains a composite metal/metal oxide layer 14 whereas the coating in FIG. 3 does not. Both coatings have been exposed to elevated temperatures in air for 2500 hours.

Specifically, FIG. 2 shows the superalloy substrate 16, the metal/metal oxide layer 14, the MCrAlY bond coat layer 12, the thermally grown oxide layer 18, and a small amount of residual thermal barrier coating layer 10 after thermal bond coat failure. FIG. 3 shows the superalloy substrate 16, the MCrAlY bond coat layer 12, the thermally grown oxide layer 18, and a small amount of residual thermal bond coat layer 10 after thermal bond coat failure. The phase visible in the MCrAlY bond coat layer 12 is beta nickel aluminide 22 (NiAl). Beta nickel aluminide 22 is the source of the aluminum responsible for forming a dense coherent thermally grown oxide layer 18 ($Al_2O_3$) which forms during service and is necessary for good oxidation resistance. Aluminum is consumed in the formation of the thermally grown oxide layer 18 and by the diffusion of aluminum into the substrate 16 material.

By comparison, it is readily apparent that there is substantially more beta nickel aluminide 22 present in FIG. 2 (containing the composite metal/metal oxide intermediate layer 14) than is present in FIG. 3. It is also readily apparent that in FIG. 2 there is only one beta depleted zone 20 within the MCrAlY bond coat due to oxidation. In contrast, FIG. 3 shows two beta depleted zones 20 within the MCrAlY bond coat in FIG. 3—one adjacent to the substrate 16 superalloy due to interdiffusion and one adjacent to the thermally grown oxide layer 18 due to oxidation. Without intending to be bound by a theory of the invention, the greater retention of beta nickel aluminide 22 in FIG. 2 is believed to be due to the aluminum oxide particles in the composite metal/metal oxide layer 14 acting as a physical barrier to aluminum diffusion into the superalloy substrate 16. Thus, the presence of the composite metal/metal oxide layer 14 retains beta nickel aluminide 22 in the MCrAlY bond coat layer 12. As a result, a longer coating life is expected.

The use of an air plasma sprayed bond coating has historically proven to exhibit inferior performance relative to a low pressure plasma sprayed bond coating. The combination of an air plasma sprayed bond coating to act as a diffusion barrier, and a high density low pressure plasma sprayed or high velocity oxygen fuel bond coating to promote formation of a dense, adherent protective alumina layer offers an improvement over the current single layer bond coating system. The oxidation of the low pressure plasma sprayed coating could further be improved through surface modification, such as aluminizing, platinum aluminizing or other surface modification techniques.

The teaching of the present invention as it relates to multilayer thermal barrier coatings are identical to multilayer overlay coating systems with one exception; in multilayer overlay coating systems the thermal barrier coating layer (1) is not present. In all other respects, the inventions are the same.

Various modifications of the invention in addition to those shown and described herein will be apparent to one skilled in the art from the foregoing description. Such modifications are also intended to fall within the scope of the appended claims.

What is claimed is:

1. A multilayer thermal barrier coating system comprising a thermal barrier coating layer deposited upon a high density metallic bond coating layer, the high density metallic bond coating layer deposited upon a diffusion resistant composite MCrAlY/metal oxide bond coating layer, and the composite MCrAlY/metal oxide bond coating layer deposited upon a substrate, wherein said diffusion resistance is provided by a method of deposition in which MCrAlY droplets become heavily decorated with oxides at the splat boundary during the deposition process.

2. The thermal barrier coating system of claim 1, further comprising a thermally grown oxide layer dispersed between the thermal barrier coating layer and the high density metallic bond coating layer.

3. Th e thermal barrier coating system of claim 1, wherein the thermal barrier coating layer comprises a low conductivity ceramic layer.

4. The thermal barrier coating system of claim 3, wherein the low conductivity ceramic layer comprises zirconia stabilized with at least one of yttria, scandia, magnesia, ceria, or a combination thereof.

5. The thermal barrier coating system of claim 1, wherein the high density metallic bond coating layer comprises a MCrAlY alloy, wherein M is at least one of Co, Ni, Fe or a combination thereof.

6. The thermal barrier coating system of claim 1, wherein the composite metal/metal oxide bond coating layer comprises a n MCrAlY and aluminum, oxide.

7. The thermal barrier coating system of claim 1, wherein the substrate comprises a cobalt based superalloy.

8. The thermal barrier coating system of claim 1, wherein the substrate comprises a nickel based superalloy.

9. The thermal barrier coating system of claim 2, wherein the thermally grown oxide layer comprises aluminum oxide.

10. A multilayer overlay coating system comprising a high density metallic bond coating layer deposited upon a diffusion resistant composite MCrAlY/metal oxide bond coating layer, the composite MCrAlY/metal oxide bond coating layer deposited upon a substrate, wherein said diffusion resistance is provided by a method of deposition in which MCrAlY droplets become heavily decorated with oxides at the splat boundary during the deposition process.

11. The overlay coating system of claim 10, wherein the high density metallic bond coating layer comprises a MCrAlY alloy, wherein M is at least one of Co, Ni, Fe or a combination thereof.

12. The overlay coating system of claim 10, wherein the composite metal/metal oxide bond coating layer comprises an MCrAlY and aluminum oxide.

13. The overlay coating system of claim 10, wherein the substrate comprises a cobalt based superalloy.

14. The overlay coating system of claim 10, wherein the substrate comprises a nickel based superalloy.

* * * * *